US008191991B2

(12) United States Patent
Hagiwara et al.

(10) Patent No.: US 8,191,991 B2
(45) Date of Patent: Jun. 5, 2012

(54) LIQUID EJECTING HEAD UNIT AND LIQUID EJECTING APPARATUS

(75) Inventors: Hiroyuki Hagiwara, Suwa (JP); Takashi Kato, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 314 days.

(21) Appl. No.: 12/693,526

(22) Filed: Jan. 26, 2010

(65) Prior Publication Data

US 2010/0188461 A1 Jul. 29, 2010

(30) Foreign Application Priority Data

Jan. 29, 2009 (JP) ..... 2009-018848

(51) Int. Cl.
*B41J 2/045* (2006.01)

(52) U.S. Cl. ..... 347/40; 347/68; 347/71

(58) Field of Classification Search ..... 347/68–71, 347/40, 43, 19, 47
See application file for complete search history.

(56) References Cited

U.S. PATENT DOCUMENTS 7,040,741 B2 * 5/2006 Nakamura et al. ..... 347/71
7,510,272 B2 * 3/2009 Nakamura et al. ..... 347/71

FOREIGN PATENT DOCUMENTS

JP 2549762 8/1996

* cited by examiner

*Primary Examiner* — Lamson Nguyen
(74) *Attorney, Agent, or Firm* — Workman Nydegger

(57) ABSTRACT

A liquid ejecting head unit includes a base plate that holds a liquid ejecting head. A position determining pin is fitted into a position determining pin inserting hole in one of the liquid ejecting head and the base plate and is positioned on the other. A guide plate has a pin support hole inserted into the position determining pin. The guide plate is configured by a lowermost layer that is bonded to the other in which the position determining pin is positioned, a middle layer, and an uppermost layer. The pin support hole is configured by a first opening portion in the uppermost layer, a second opening portion in the lowermost layer, and a communication opening portion in the middle layer and allows the first and second opening portions to communicate with each other. The position determining pin is supported by the first and second opening portions.

9 Claims, 7 Drawing Sheets

LIQUID EJECTING HEAD UNIT AND LIQUID EJECTING APPARATUS

BACKGROUND

1. Technical Field

The present invention relates to a liquid ejecting head unit and a liquid ejecting apparatus, and more particularly, to an ink jet recording head and an ink jet recording apparatus ejecting ink as liquid.

2. Related Art

Liquid ejecting apparatuses represented by ink jet recording apparatuses such as ink jet printers and plotters include liquid ejecting head units (hereinafter, also referred to as head units) in which a plurality of liquid ejecting heads capable of ejecting liquid such as ink stored in an cartridge, a tank, or the like as liquid droplets is disposed.

The plurality of liquid ejecting heads is placed in a base plate that is a common holding member. The arrangement of the plurality of liquid ejecting heads is made such that nozzle rows, in which nozzle openings of each liquid ejecting head are arranged in parallel, are placed to be consecutive in the direction of the arrangement.

In order to improve the accuracy of the landing position of the liquid, each liquid ejecting head needs to be installed to the base plate after the position of the nozzle opening is determined with high accuracy. As a method of determining the position of the liquid ejecting head, for example, there is technology for forming key grooves and keys in an alignment substrate (corresponding to a base plate), which is formed from silicon, and components (corresponding to liquid ejecting heads) disposed thereon by using a photolithographic method and determining the positions of the components on the alignment substrate to be predetermined positions by fitting the keys into the key grooves (for example, see Japanese Patent No. 2549762).

However, in the above-described technology disclosed in Japanese Patent No. 2549762, silicon can be cracked easily. Thus, when the liquid ejecting head is repeatedly attached to and detached from the base plate, the keys or the key grooves for position determination are cracked or broken. Accordingly, the accuracy of the position of the liquid ejecting head with respect to the base plate decreases. Therefore, there is a problem that the accuracy of the landing position of the liquid is degraded.

In addition, such a problem is not limited to an ink jet recording head unit and exists also in a liquid ejecting head unit that ejects liquid other than ink.

SUMMARY

An advantage of some aspects of the invention is that it provides a liquid ejecting head unit and a liquid ejecting apparatus capable of preventing a decrease in the accuracy of position determination due to repetitive attachment and detachment of the liquid ejecting head to and from the base plate.

According to a first aspect of the invention, there is provided a liquid ejecting head unit including: a liquid ejecting head that has a nozzle row in which a plurality of nozzle openings are arranged in parallel; a base plate that holds the liquid ejecting head; a position determining pin, which is fitted into a position determining pin inserting hole disposed in one of the liquid ejecting head and the base plate, disposed on the other; and a guide plate that has a pin support hole inserted into the position determining pin. The guide plate is configured by a lowermost layer portion that is bonded to the other in which the position determining pin is disposed, a middle layer portion disposed on the lowermost layer portion, and an uppermost layer portion that is disposed on the middle layer portion. In addition, the pin support hole is configured by a first opening portion disposed in the uppermost layer portion, a second opening portion disposed in the lowermost layer portion, and a communication opening portion that is disposed in the middle layer portion and allows the first opening portion and the second opening portion to communicate with each other, and the position determining pin is supported by the first opening portion and the second opening portion.

According to the first aspect, the position determining pin that determines the positions of the liquid ejecting head and the base plate is supported by the first opening portion and the second opening portion that are formed in the uppermost layer portion and the lowermost layer portion configuring the guide plate. As described above, since the guide plate is formed by stacking the uppermost layer portion, the middle layer portion, and the lowermost layer portion together, the uppermost layer portion and the lowermost layer portion can be formed to be thin. Accordingly, even when the first opening portion and the second opening portion are formed to be tilted in the uppermost layer portion and the lowermost layer portion, the influence thereof is a little or ignorable. As a result, compared to a case where the support is made by arranging a pin support hole, which is formed by perforating the guide plate in the thickness direction, in the guide plate and inserting the position determining pin into the pin support hole, the position determining pin is supported by the above-described guide plate in the state being vertically arranged with high accuracy by the liquid ejecting head or the base plate.

Accordingly, as the position determining pin inserting hole is fitted with the position determining pin, the liquid ejecting head is arranged in a predetermined position on the base plate with high accuracy.

In the above-described liquid ejecting head unit, it is preferable that an opening edge portion of the communication opening portion is disposed on the outer side relative to that of the first opening portion or the second opening portion. Accordingly, the guide plate can be formed by determining the positions of the first and second opening portions so as to allow the position determining pin to be supported by the first and the second opening portions. Therefore, the position of the communication opening portion doest not need to be determined to be the first opening portion or the second opening portion. Therefore, the forming of the guide plate is simplified, whereby the costs of the head unit can be reduced. In addition, a space is formed between the communication opening portion and the position determining pin, and accordingly, this space becomes the back clearance of adhesive agents that bonds the uppermost layer portion, the middle layer portion, and the lowermost layer portion. By arranging this space, the adhesive agents are prevented from burying the pin support hole.

In addition, in the above-described liquid ejecting head unit, it is preferable that any two of the uppermost layer portion, the middle layer portion, and the lowermost layer portion are formed from silicon substrates having a crystal plane orientation of (110), and the crystal plane orientations of the two silicon substrates intersect with each other in the plan view of the guide plate. In such a case, the strength of the guide plate for the bending stress is improved. Accordingly, it can be prevented that the uppermost layer portion or the lowermost layer portion is broken in accordance with the bending stress that is generated when the position determining pin is inserted into the pin support hole.

In addition, in the above-described liquid ejecting head unit, it is preferable that the position determining pin is bonded to the base plate for being fixed. Thus, even in a case where a force is applied to the position determining pin in a direction for being extracted from the pin support hole when the liquid ejecting head is separated from the base plate, the position determining pin does not drop out of the pin support hole so as not to slide to the pin support hole. Accordingly, it is difficult for the force to be applied to the guide plate. As a result, the guide plate can be protected from an external force applied at the time of separation of the head.

In addition, in the above-described liquid ejecting head unit, it is preferable that a first reference is formed in the base plate, the first opening portion and a second reference of which a position is determined to be the first reference are formed in the uppermost layer portion by a photolithographic method, and the guide plate is attached to the base plate such that the first reference and the second reference are in a predetermined arrangement. In such a case, the position of the position determining pin is determined to be the first reference with high accuracy through the second reference. Accordingly, the nozzle opening of the liquid ejecting head is arranged in a predetermined position on the base plate with high accuracy.

In addition, in the above-described liquid ejecting head unit, it is preferable that the guide plate is formed by bonding a plurality of silicon substrates to be stacked, and etching is performed for a bonding face of the silicon substrate for another silicon substrate. In such a case, the anchor effect increases, whereby the guide plate in which the silicon substrates are more firmly bonded together is formed.

In addition, in the above-described the liquid ejecting head unit, it is preferable that resin is disposed on a side face of the guide plate and a boundary portion of the position determining pin and the pin support hole. In such a case, penetration of the liquid into the adhesive agent bonding the layers of the guide plate can be prevented.

In addition, the above-described liquid ejecting head unit, it is preferable that a position determining plate, in which the position determining pin inserting hole is disposed such that a relative position with respect to the nozzle opening is in a predetermined arrangement, attached to the liquid ejecting head is further included, and the liquid ejecting head is fixed to the base plate in a state in which the position determining pin is fitted into the position determining pin inserting hole of the position determining plate. In such a case, the relative position between the position determination inserting hole and the nozzle opening can be defined with high accuracy.

According to a second aspect of the invention, there is provided a liquid ejecting apparatus that includes the above-described the liquid ejecting head unit.

According to the second aspect, a liquid ejecting apparatus that can determine the position of the liquid ejecting head with high accuracy in a simple manner is provided.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter embodiments of the invention will be described in detail.

Embodiment 1

Figure 1:
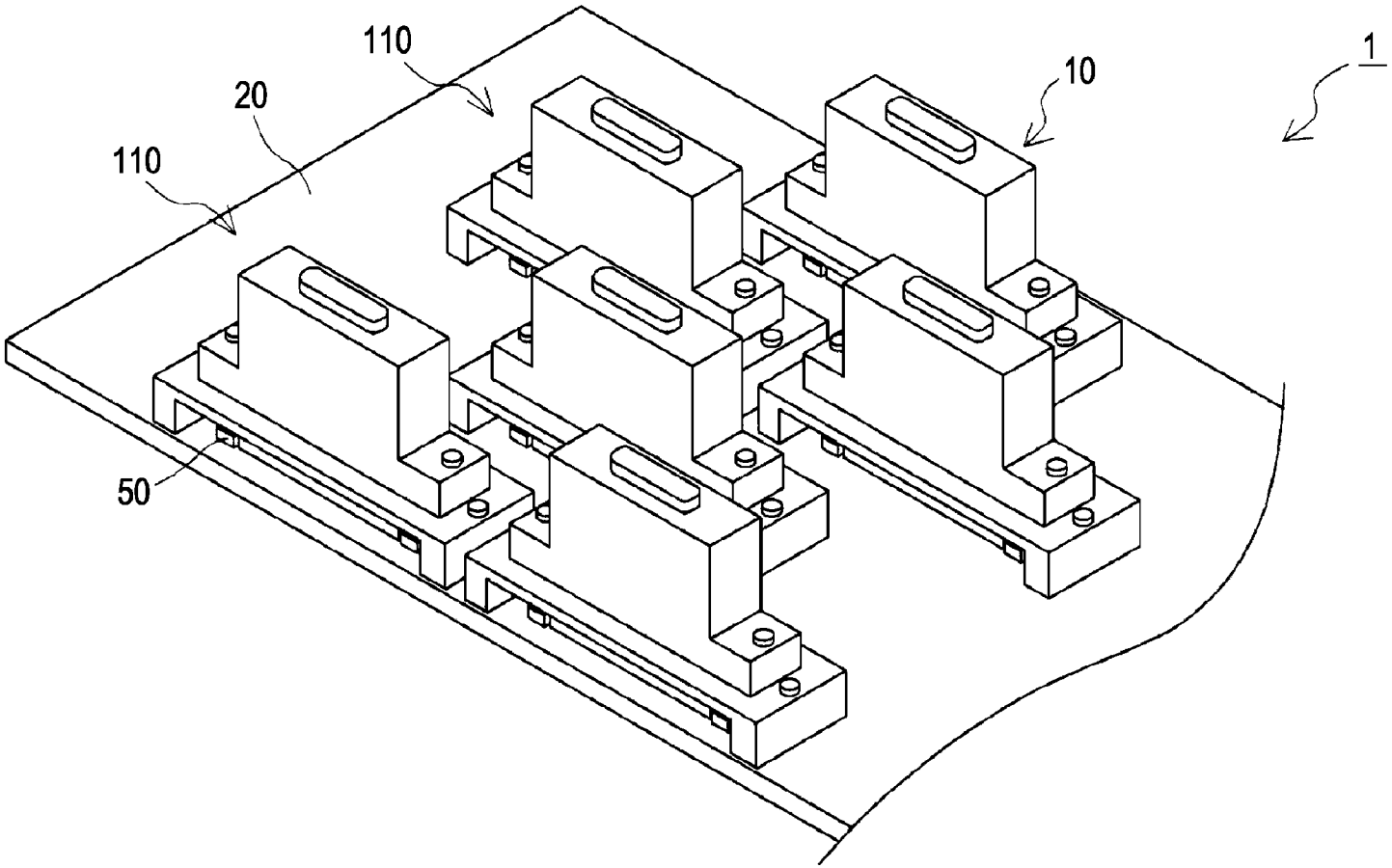
FIG. 1 is a schematic perspective view of an ink jet recording head unit according to Embodiment 1 of the invention.
Figure 2:
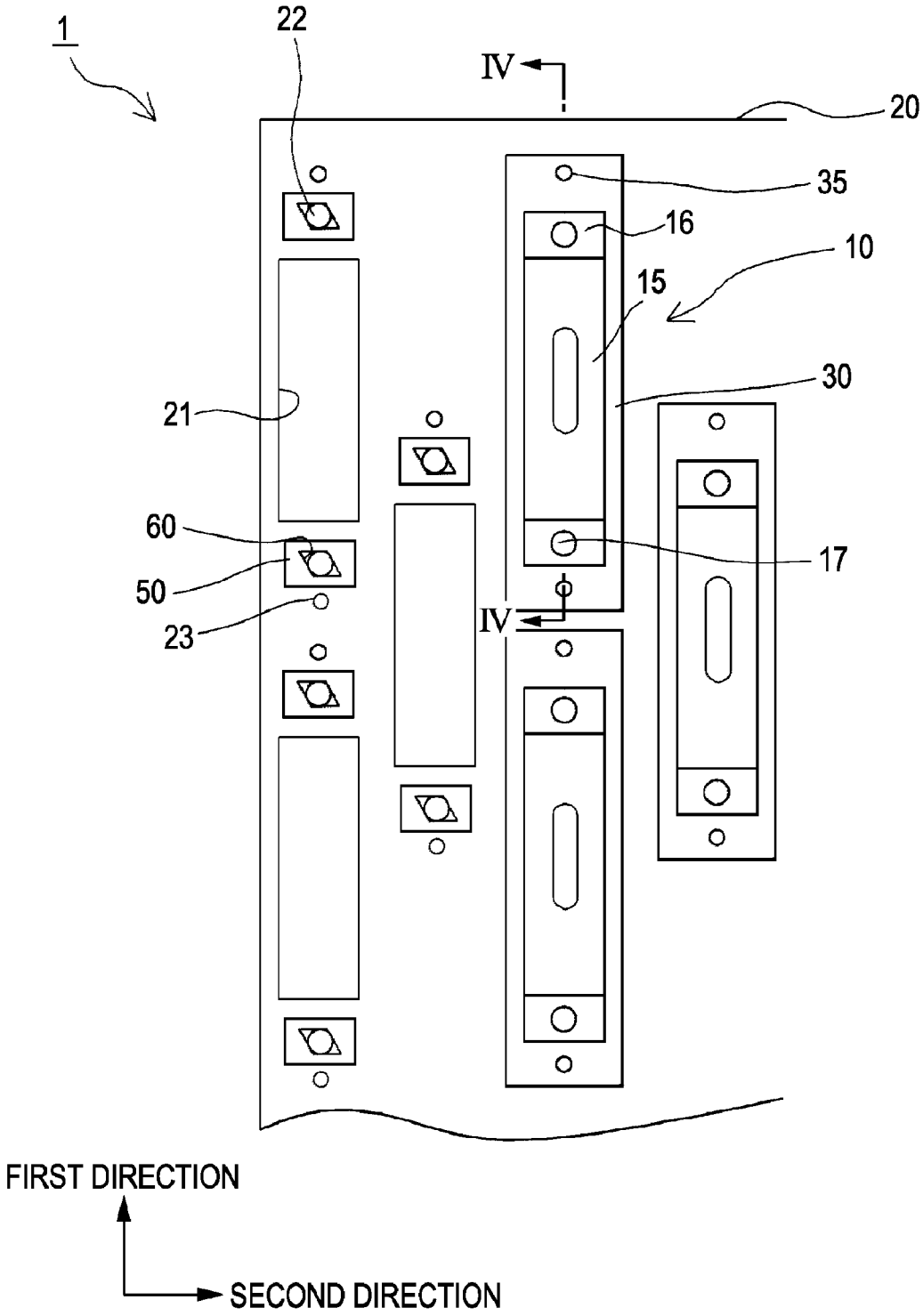
FIG. 2 is a plan view of an ink jet recording head unit according to Embodiment 1.
Figure 3:
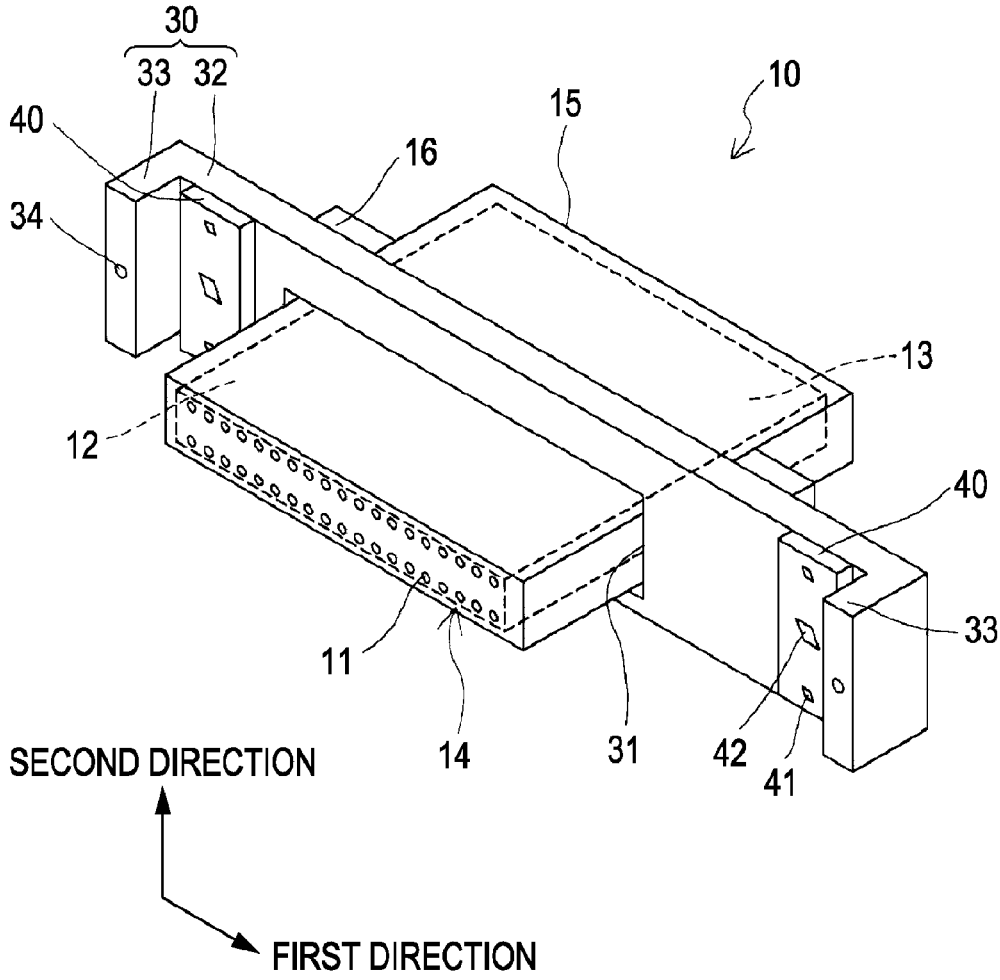
FIG. 3 is a schematic perspective view of an ink jet recording head according to Embodiment 1.
Figure 4:
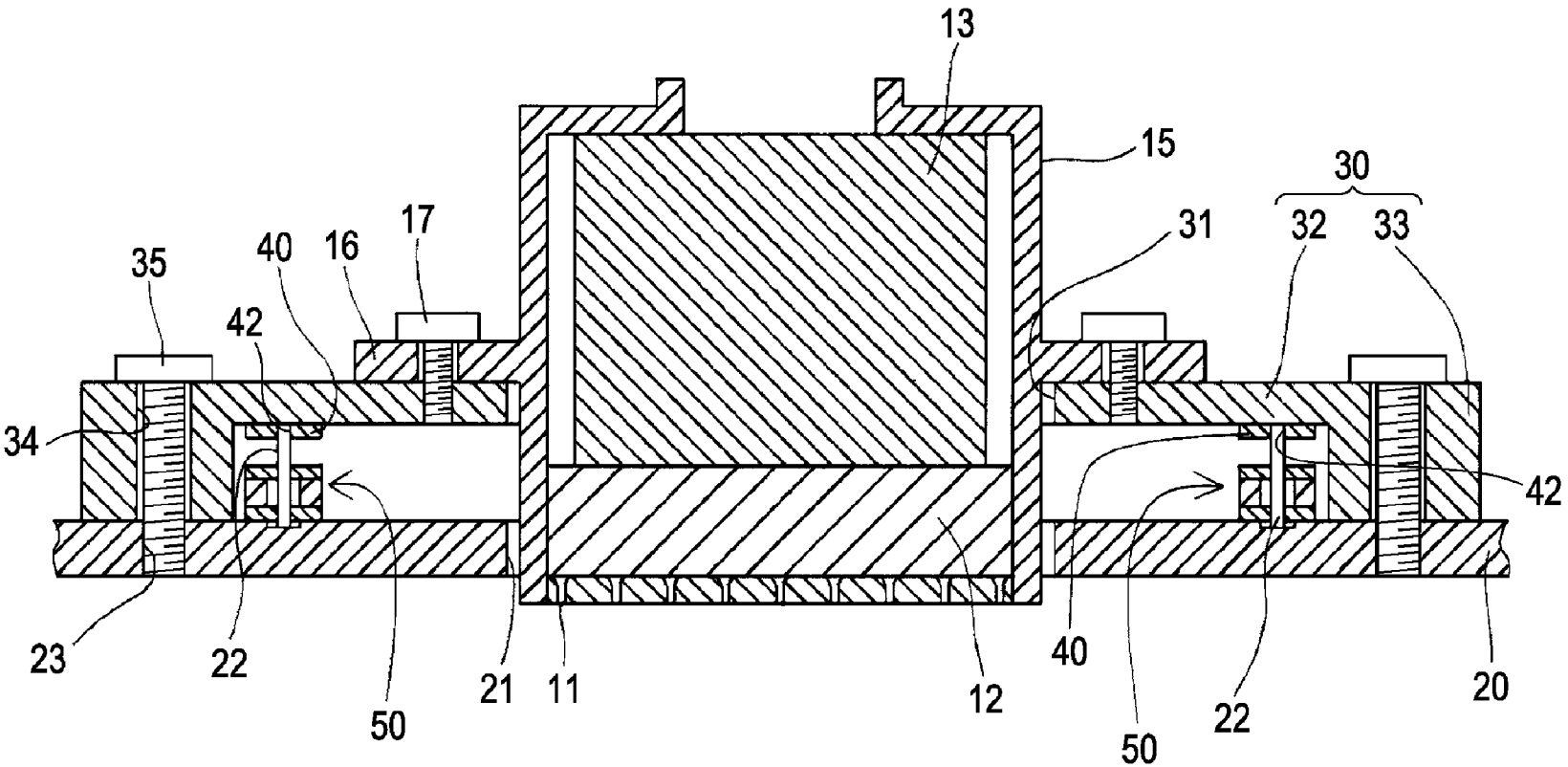
FIG. 4 is a cross-sectional view taken along line IV-IV shown in FIG. 2.

FIG. 1 is a schematic perspective view of an ink jet recording head unit as an example of a liquid ejecting head unit according to Embodiment 1 of the invention. FIG. 2 is a plan view of an ink jet recording head unit according to Embodiment 1 of the invention. FIG. 3 is a schematic perspective view of an ink jet recording head as an example of a liquid ejecting head according to Embodiment 1 of the invention. FIG. 4 is a cross-sectional view taken along line IV-IV shown in FIG. 2.

As shown in FIG. 1, the ink jet recording head unit 1 (hereinafter, also referred to as a head unit) of this embodiment includes a base plate 20 in which a plurality of ink jet recording heads 10 (hereinafter, also referred to as heads) is disposed.

As shown in FIGS. 1 and 2, in the base plate 20, one through hole 21, which is formed by perforating the base plate 20 in the thickness direction, is formed for each head 10. In the state in which the head 10 is inserted into the through hole 21, each head 10 is fixed though a sub plate 30.

The through hole 21 is disposed as an opening that is slightly greater than the outer periphery of a head case 15 of the head 10 and less than the sub plate 30. Accordingly, when the head 10 is inserted into the through hole 21, the sub plate 30 of the head 10 is held in the base plate 20. In addition, there is a gap between the head 10 and the through hole 21, thus, the head 10 can slightly move with respect to the base plate 20 in the first direction and the second direction.

In the base plate 20, a position determining pin 22 is disposed in a predetermined position of the base plate 20. The position determining pin 22 is fitted into a position determining pin inserting hole 42 (see FIG. 3) disposed in the head 10 to be described later. As the position determining pin 22 is fitted into the position determining pin inserting hole 42, the head 10 is disposed in a predetermined position of the base plate 20. In addition, the position determining pin 22 is formed from a material that does not easily wear by being fitted into the position determining pin inserting hole 42. As such a material, there are metal such as SUS, glass, ceramics, a resin, and the like. As described above, by forming the position determining pin 22 from a material that does not easily wear, even in a case where the head 10 is repetitively attached to and detached from the base plate 20, the position determining pin 22 is sufficiently fitted into the position determining pin inserting hole 42. Accordingly, the accuracy of the position of the head 10 with respect to the base plate 20 does not easily degrade.

In addition, in the base plate 20, a guide plate 50 is disposed. In the guide plate 50, a pin support hole 60 into which the position determining pin 22 is inserted is disposed, and the position determining pin 22 is supported by the pin support hole 60.

As will be described later in detail, the mounting strength of the position determining pin 22 with respect to the base plate 20 is improved by the guide plate 50. Thus, even in a case where the position determining pin 22 is repetitively inserted into and extracted from the position determining pin inserting hole 42, the position determining pin 22 is prevented from being deviated or tilted with respect to the base plate 20. In addition, as will be described later in detail, the position determining pin 22 is disposed in a predetermined position of the base plate 20 with high accuracy through the guide plate 50. Thus, the position determining pin 22 is disposed in the base plate 20 such that relative positions of a plurality of heads 10 form a predetermined disposition with high accuracy in a case where the position determining pin 22 is fitted into the position determining pin inserting hole 42.

In this embodiment, one position determining pin 22 is disposed on each of both sides of each through hole 21 of the base plate 20 in a first direction, to be described later, and one guide plate 50 is disposed for each determination pin 22. In addition, in the base plate 20, a fixation screw hole 23, into which a fixation screw 35 used for fixing the sub plate 30 of the head 10 is fitted, is disposed on the outer side of the guide plate 50 that is opposite to the side of the guide plate 50 on which the head 10 is formed.

As shown in FIGS. 3 and 4, the head 10 of this embodiment includes: a head main body 12 having nozzle openings 11 on one end face thereof; a flow path member 13 that is fixed to the side of the head main body 12 that is opposite to the nozzle openings 11; a head case 15 housing head main body 12 and the flow path member 13; a sub plate 30 that is used for mounting the head case 15 to the base plate 20; and a position determining plate 40 that is used for determining the position of the head 10 to be a predetermined position on the base plate 20.

The head main body 12 includes nozzle rows 14 in which the nozzle openings 11 are aligned. The number of the nozzle rows 14 is not particularly limited. For example, the number of the nozzle rows 14 may be one, two, or more. In this embodiment, the nozzle rows 14 are disposed to be aligned in two rows in one head main body 12. Here, in this embodiment, a direction in which the nozzle openings 11 are aligned in the nozzle row 14 is set as a first direction, and a direction intersecting the first direction is set as a second direction. As a result, the nozzle rows 14 of two rows are aligned in the second direction.

In addition, inside the head main body 12, although not shown in the figure, a pressure generating chamber configuring a part of a flow path that communicates with the nozzle openings 11 and a pressure generating unit that allows ink to be ejected from the nozzle openings by generating a pressure change in the pressure generating chamber are disposed.

The pressure generating unit is not particularly limited. For example, a pressure generating unit that uses a piezoelectric element in which a piezoelectric material exhibiting an electromechanical conversion function is interposed between two electrodes, a pressure generating unit that has a heater element disposed inside a pressure generating chamber and allows ink to be ejected from nozzle openings 11 by bubbles generated by the heat that is generated by the heater element, a pressure generating unit that generates static electricity between a vibration plate and an electrode and allows ink to be ejected from nozzle openings 11 by transforming the vibration plate utilizing an electrostatic force, or the like may be used. In addition, as the piezoelectric element, a piezoelectric element of the flexure-vibration type in which a lower electrode, a piezoelectric material, and an upper electrode are stacked from the side of a pressure generating chamber and are flexurally transformed, a piezoelectric element of the vertical-vibration type in which piezoelectric materials and electrode forming materials are alternately stacked so as to expand or contract in the axial direction, or the like may be used.

The flow path member 13 is fixed to a face of the head main body 12 that is opposite to the nozzle openings 11. The flow path member 13 supplies ink from the outside to the head main body 12 or discharges ink from the head main body 12 to the outside. In a face of the flow path member 13 that is opposite to the face fixed to the head main body 12, a liquid flow path opening (not shown) in which an internal flow path is open so as to be connected to an external flow path and a connector (not shown) to which an electric signal such as a print signal transmitted from the outside is supplied are disposed.

The head case 15 houses the head main body 12 and the flow path member 13 therein. In addition, in the head case 15, flange portions 16 that protrude to the outer sides are disposed on both side faces in the first direction. Each flange portion 16 is fixed to the sub plate 30 by using the head case fixation screw 17.

The sub plate 30 is a member that is used for mounting the head case 15 on the base plate 20. In particular, the sub plate 30 is configured by a base portion 32 in which a head inserting hole 31 is disposed and a leg portion 33 that is disposed on one face of the base portion 32.

The flange portions 16 of the head case 15 are fixed to the base portion 32 of the sub plate 30 in the state in which the head case 15 is inserted into the head insertion hole 31. In addition, in the leg portion 33 of the sub plate 30, a fixation screw inserting hole 34, which is formed by perforating the leg portion 33 in the thickness direction, is formed. By fitting the fixation screw 35 into the fixation screw hole 23 in the state in which the fixation screw 35 is inserted into the fixation screw inserting hole 34, the sub plate 30 is fixed to the base plate 20. In addition, the fixation screw inserting hole 34 has a diameter slightly larger than that of the fixation screw 35, and accordingly, the sub plate 30 can slightly move in the first direction and the second direction. This is for fine adjustment that is performed for the position of the sub plate 30 with respect to the base plate 20 in a case where the position determining pin 22 is fitted into the position determining pin inserting hole 42 that is disposed in a position determining plate 40 to be described later.

In the sub plate 30, a total of two position determining plates 50 located on both sides with the through hole 21 interposed therebetween are attached to a face located on the nozzle opening portion 11 side of the base portion 32. The position determining plate 40 is formed from a silicon substrate. In the position determining plate 40, a position determination adjusting hole 41 and the position determining pin inserting hole 42 are formed.

The position determining pin inserting hole 42 is a hole into which the position determining pin 22 disposed in the base plate 20 is fitted. In addition, the position determination adjusting hole 41, to be described later in detail, is a hole that is used for determining the position in a case where the position determining plate 40 is attached to the sub plate 30.

The position determination adjusting hole 41 and the position determining pin inserting hole 42 are formed on the position determining plate 40 by using a photolithographic method. Thus, the position determination adjusting hole 41 and the position determining pin inserting hole 42 are formed in predetermined positions on the position determining plate 40 with high accuracy, for example, with a dimension tolerance smaller than that of a case where the position determining plate is formed by injecting and molding a resin.

The position determining plate 40 is attached to the sub plate 30 in the state in which the positions of the position determination adjusting hole 41 and the nozzle openings 11 are determined to be predetermined positions. Here, to determine the positions of the position determination adjusting hole 41 and the nozzle openings 11 to be predetermined positions is to position the position determination adjusting hole 41 to be apart from the nozzle openings 11 by predetermined distances in the first direction and the second direction in the plan view when the head 10 is viewed from the nozzle opening 11 side.

As described above, the positions of the position determination adjusting hole 41 and the nozzle openings 11 are determined to be predetermined positions, and the position determination adjusting hole 41 and the position determining pin inserting hole 42 are formed in predetermined positions on the position determining plate 40 with high accuracy by using photolithography. Accordingly, the relative positions of the position determining pin inserting hole 42 and the nozzle openings 11 are also defined with high accuracy. In other words, the position determining pin inserting hole 42 is positioned to be apart from the nozzle openings 11 by predetermined distances in the first direction and the second direction, in the plan view when the head 10 is viewed from the nozzle opening 11 side.

In this embodiment, one position determining pin inserting hole 42 is formed in a center portion of each position determining plate 40, and two position determination adjusting holes 41 are formed on both sides in the second direction with the center portion of the position determining plate 40 interposed therebetween.

The above-described position determining plate 40 is formed by forming a photoresist pattern on a position determining plate 40 so as to allow the position determining pin inserting hole 42 and the position determination adjusting hole 41 to be formed in predetermined positions and then etching the position determining plate 40. In this embodiment, the position determining plate 40 is formed from silicon. However, the material of the position determining plate 40 is not particularly limited to a material as long as the material allows the position determining pin inserting hole 42 and the position determination adjusting hole 41 to be formed by using photolithography. As such a material, metal such as SUS, glass, or the like can be used.

As described above, the head 10 to which the position determining plates 40 are installed is fixed to the base plate 20 by using the fixation screw 35 in the state in which the position determining pin inserting hole 42 is fitted with the position determining pin 22. In other words, the position determining pin inserting hole 42 is regulated to move in the first direction and the second direction by being fitted with the position determining pin 22. Accordingly, the position of the position determining pin inserting hole 42 is defined.

In addition, the position determining pin inserting hole 42 has an opening of a rhombic shape. Thus, the horizontal cross section of the position determining pin 22 has a circle shape inscribed in the shape of the opening of the position determining pin inserting hole 42. Accordingly, there is no allowance between the position determining pin inserting hole 42 and the position determining pin 22. As a result, the positions of the position determining pin inserting hole 42 and the position determining pin 22 can be determined more accurately.

Figure 5A:
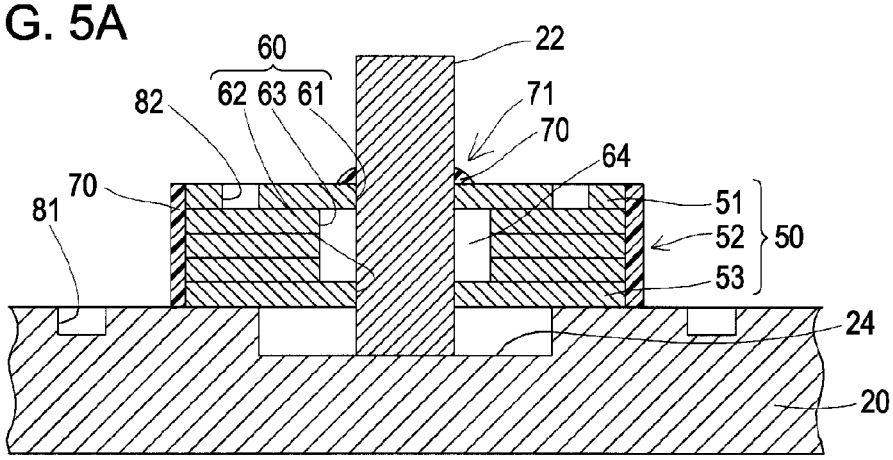
FIGS. 5A, 5B, and 5C are a cross-sectional view, a plan view, and the like of a guide plate and a position determining pin.
Figure 5B:
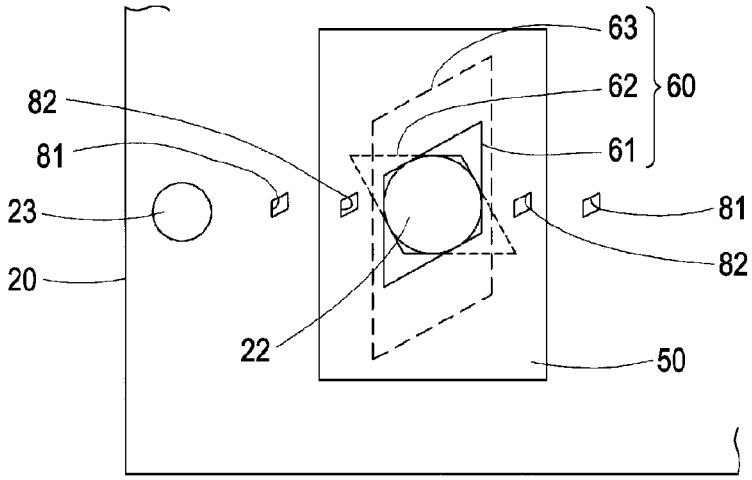
Figure 5C:
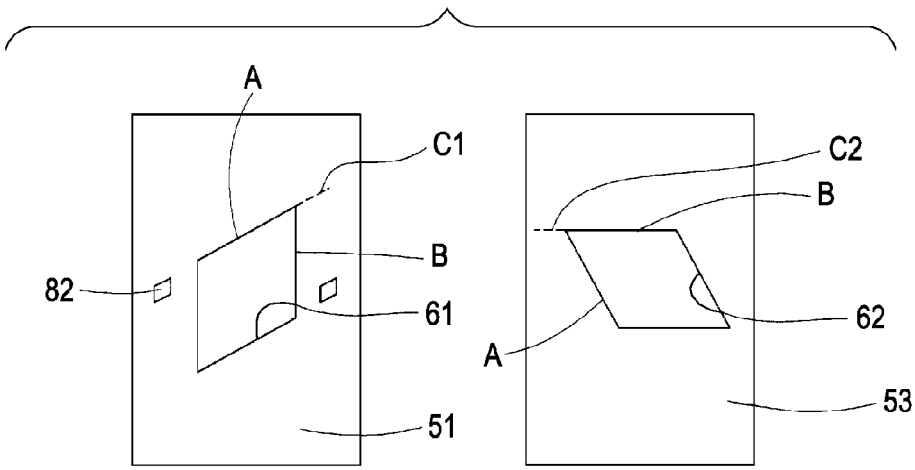

Here, the guide plate 50 and the position determining pin 22 will be described in detail. FIG. 5A is an enlarged cross-sectional view of a major portion of the guide plate and the position determining pin according to an embodiment of the invention. FIG. 5B is an enlarged plan view of a major portion of the guide plate and the position determining pin. In addition, FIG. 5C shows plan views of an uppermost layer portion and a lowermost layer portion that configure the guide plate.

As shown in FIGS. 5A and 5B, an installation groove 24 is formed in the base plate 20, and the position determining pin 22 is vertically arranged in the installation groove 24. In addition, the guide plate 50 is bonded to the base plate 20, and the position determining pin 22 is inserted into the support hole 60 disposed in the guide plate 50.

In addition, the position determining pin 22 is bonded to the base plate 20 by using an adhesive agent. Thus, even in a case where a force is applied to the position determining pin 22 in a direction for being extracted from the pin support hole 60 when the head 10 is separated from the base plate 20, the position determining pin 22 does not drop out of the pin support hole 60. Accordingly, it is difficult for the force to be applied to the guide plate 50. As a result, the guide plate 50 can be protected from an external force applied at the time of separation of the head.

The guide plate 50 is configured by a lowermost layer portion 53 that is bonded to the base plate 20, a middle layer portion 52 that is disposed on the lowermost layer portion 53, and an uppermost layer portion 51 that is disposed on the middle layer portion 52. In this embodiment, the lowermost layer portion 53 is formed from one silicon substrate, and the uppermost layer portion 51 is also formed from one silicon substrate. On the other hand, the middle layer portion 52 is formed by bonding three silicon substrates. In addition, the crystal plane orientation of each silicon substrate is (110). In addition, the configuration of the layers of the guide plate 50 is not limited thereto. Thus, the lowermost layer portion 53 and the uppermost layer portion 51 may be configured from a plurality of silicon substrates, and the middle layer portion 52 may be configured from one silicon substrate. In addition, the material of the uppermost layer portion 51 and the lowermost layer portion 53 are not limited to the silicon substrate. Thus, any material can be used as long as the first opening portion 61 and the second opening portion 62 can be formed in the uppermost layer portion 51 and the lowermost layer portion 52 by using the photolithographic method. For example, as the material thereof, metal such as SUS, glass, or the like may be used.

Each silicon substrate that configures the uppermost layer portion 51, the middle layer portion 52, or the lowermost portion 53 is bonded to another adjacent silicon substrate by using an adhesive agent. In addition, the lowermost layer portion 53 is bonded to the base plate 20 by using an adhesive agent. For the bonding face of each silicon substrate that configures the uppermost layer portion 51, the middle layer portion 52, and the lowermost layer portion 53 to which another silicon substrate is bonded, etching is performed, and accordingly, the anchor effect due to the adhesive agent increases. Accordingly, the guide plate 50 in which the uppermost layer portion 51, the middle layer portion 52, and the lowermost layer portion 53 are firmly bonded together is formed.

The pin support hole 60 is configured by a first opening portion 61 that is disposed in the uppermost layer portion 51 and is formed in the thickness direction thereof, a second opening portion 62 that is disposed in the lowermost layer portion 53 and is formed in the thickness direction, and a communication opening portion 63 that is disposed in the middle layer portion 52 and communicates with the first opening portion 61 and the second opening portion 62.

The first opening portion 61 and the second opening portion 62 are formed in the uppermost layer portion 51 and the lowermost layer portion 53 by using the photolithographic method. The shapes of the opening portions of the first opening portion 61 and the second opening portion 62 are formed in an approximate rhombus shape in the plan view of the lowermost layer portion 53 and the uppermost layer portion 51 so as to allow the position determining pin 22 to be inscribed therein. The first opening portion 61 and the second opening portion 62 of the approximate rhombus shapes can be formed by performing wet etching for silicon substrates having the crystal plane orientation (110).

In addition, the communication opening portion 63 is disposed such that the opening edge portion thereof is positioned to the outer side in the second direction relative to the opening edge portions of the first and second opening portions 61 and 62 in the plan view of the guide plate 50. In other words, the opening edge portion of the communication opening portion 63 is apart from the position determining pin 22. Accordingly, the guide plate 50 can be formed by determining the positions of the first and second opening portions 61 and 62 so as to allow the position determining pin 22 to be supported by the first and the second opening portions 61 and 62. Therefore, the position of the communication opening portion 63 does not need to be determined to be the first opening portion 61 or the second opening portion 62. Accordingly, the position of the communication opening portion 63 does not need to be determined with high accuracy with respect to the first opening portion 61 and the second opening portion 62 by forming the communication opening portion 63 with high accuracy by using a photolithographic method or the like. Therefore, the forming of the guide plate is simplified, whereby the costs of the head unit 1 can be reduced. In addition, a space 64 is formed between the communication opening portion 63 and the position determining pin 22. This space 64 becomes the back clearance of adhesive agents between the silicon substrates that configure the uppermost layer portion 51, the middle layer portion 52, and the lowermost layer portion 53. By arranging this space 64, the adhesive agents between the silicon substrates are prevented from burying the pin support hole 60.

In addition, the first opening portion 61 and the second opening portion 62 support the position determining pin 22 on the sides. The support of the first and second opening portions 61 and 62 for the position determining pin 22 represents regulation of the movement or the tilt of the position determining pin 22 in the horizontal direction (the first direction or the second direction). The mounting strength of the position determining pin 22 for the base plate 20 is improved by the support of the first and second opening portions 61 and 62. Accordingly, the position determining pin 22 is prevented from being moved or tilted with respect to the base plate 20. Therefore, even when the fitting of the position determining hole 42 with the position determining pin 22, that is, the attachment and the detachment of the head 10 to or from the base plate 20 is repetitively performed, a decrease in the mounting accuracy of the head 10 for the base plate 20 due to deviation of the position determining pin 22 from the mounting position or the like is prevented.

In this embodiment, the first opening portion 61 and the second opening portion 62 support the position determining pin 22 with the position determining pin 22 being inscribed therein. However, the invention is not limited thereto. For example, it may be configured that the first opening portion 61 regulates the deviation or the tilt of the position determining pin 22 in the first direction, and the second opening portion 62 regulates the deviation or the tilt of the position determining pin 22 in the second direction. In addition, there may be a slight allowance between the first and second opening portions 61 and 62 and the position determining pin 22. In such a case, the support of the first and second opening portions 61 and 62 for the position determining pin 22 includes the state in which further movement or tilt of the position determining pin 22 is regulated by the first opening portion 61 and the second opening portion 62 even in a case where the position determining pin 22 is slightly moved or tilted by application of an external force from the sides of the position determining pin 22.

In addition, the guide plate 50 is formed by forming the first opening portion 61, the communication opening portion 63, and the second opening portion 62 in the uppermost layer portion 51, the middle layer portion 52, and the lowermost layer 53, determining the positions of the first and second opening portions 61 and 62 so as to allow the position determining pin 22, which is inserted into the pin support hole 60, to be supported by the first and second opening portions 61 and 62, and bonding the uppermost layer portion 51, the middle layer portion 52, and the lowermost layer portion 53 together.

Here, in a case where the guide plate is formed from one layer, for example, one silicon substrate, when the pin support hole is formed to be tilted in the guide plate, in other words, when the pin support hole is formed so as not to follow the direction of the normal line of the guide plate, as the thickness of the guide plate becomes larger, a deviation between one opening and the other opening of the pin support hole in the plan view increases. Accordingly, the position determining pin is supported by the pin support hole in a tilted state. Therefore, the accuracy of the position determination of the head 10, of which the position is determined as the position determining pin inserting hole 42 is fitted with the position determining pin, decreases.

However, since the guide plate 50 according to an embodiment of the invention is formed by stacking the uppermost layer portion 51, the middle layer portion 52, and the lowermost layer portion 53 together, the uppermost layer portion 51 and the lowermost layer portion 53 can be formed to be thin. Accordingly, even when the first opening portion 61 and the second opening portion 62 are formed to be tilted in the uppermost layer portion 51 and the lowermost layer portion 53, the influence thereof is small or negligible. As a result, compared to a case where the support is made by arranging a pin support hole, which is formed by perforating the guide plate in the thickness direction, in the guide plate and inserting the position determining pin 22 into the pin support hole, the position determining pin 22 is supported by the guide plate 50 according to an embodiment of the invention in the state being vertically arranged with high accuracy by the base plate 20.

In addition, since the first opening portion 61 and the second opening portion 62 are formed in the uppermost layer portion 51 and the lowermost layer portion 53 that are interposed by the middle layer portion 52 therebetween, the position determining pin 22 is supported in two spots apart from the side face of the position determining pin 22. Accordingly, the position determining pin 22 is supported by the guide plate 50 in the state being arranged vertically with respect to the base plate 20 with higher accuracy. In addition, the communication opening portion 63 of the middle layer portion 52 may be configured to support the position determining pin 22. In such a case, the position determining pin 22 is supported more firmly.

As described above, the guide plate 50 can maintain the state in which the position determining pin 22 is arranged vertically with respect to the base plate 20 with high accuracy. Accordingly, the position of the head 10 having the position determining pin inserting hole 42, into which the position determining pin 22 is fitted, on the base plate 20 is determined with high accuracy. In addition, since the first opening portion 61 and the second opening portion 62 are formed by using the photolithographic method, compared to a general mechanical process, the dimension tolerance is small. Accordingly, the position determining pin 22 is supported by the guide plate 50 in the state being arranged vertically with respect to the base plate 20 with higher accuracy. As a result, the position of the head 10 on the base plate 20 is determined with much higher accuracy.

In addition, in this embodiment, resins 70 are disposed in the side face of the guide plate 50 and a boundary portion 71 of and the position determining pin 22 and the pin support hole 60. The resin 70 disposed on the side face of the guide plate 50 prevents the entrance of liquid such as ink from the side face of the guide plate 50 to the bonding surfaces of the uppermost layer portion 51, the middle layer portion 52, and the lowermost layer portion 53. In addition, the resin 70 disposed in the boundary portion 71 prevents the entrance of liquid such as ink from the pin support hole 60 to the bonding surface through a gap between the position determining pin 22 and the pin support hole 60. By using the resins 70, the bonding strength of the adhesive agent (not shown) that bonds the uppermost layer portion 51, the middle layer portion 52, and the lowermost layer portion 53 together is maintained, whereby the durability of the guide plate 50 is improved. In addition, the resin 70 may be disposed on the inner face of the communication opening portion 63. Also in such a case, the entrance of the ink or the like to the bonding faces of the uppermost layer portion 51, the middle layer portion 52, and the lowermost layer portion 53 from the pin support hole 60 can be prevented.

As shown in FIG. 5C, directions along a first (111) plane A and a second (111) plane B of the uppermost layer portion 51 and the lowermost layer portion 53 intersect with each other in the plan view of the guide plate 50. Generally, when a bending stress is applied to a silicon substrate, a crack C1 or a crack C2 may be easily generated in directions along the first (111) plane A and the second (111) plane B. Accordingly, in a case where the crystal orientations of the uppermost layer portion 51 and the lowermost layer portion 53 are in the same direction, the entire guide plate 50 may be easily cracked. However, in this embodiment, since the direction along the first (111) plane A and the direction along the second (111) plane B intersect with each other in the plan view of the guide plate 50 (see FIG. 5C), the strength of the guide plate 50 for the bending stress is improved. Accordingly, it can be prevented that the uppermost layer portion 51 or the lowermost layer portion 53 is broken in accordance with the bending stress that is generated when the position determining pin 22 is inserted into the pin support hole 60.

Here, the disposition of the position determining pin 22 with respect to the base plate 20 will be described. As shown in FIGS. 2, 5A, and 5B, a first position determining hole 81 as an example of a first reference is formed in the base plate 20, and a second position determining hole 82 as an example of a second reference is formed in the uppermost layer portion 51 of the guide plate 50. The second position determining hole 82 is formed in the uppermost layer portion 51 together with the first opening portion 61 by using the photolithographic method. Accordingly, the second position determining hole 82 and the first opening portion 61 are formed in predetermined positions on the uppermost layer portion 51 with high accuracy, with a small tolerance, for example, compared to a case where the uppermost layer portion 51 is formed by injecting and molding a resin.

In addition, the position of the second position determining hole 82 is determined in the first position determining hole 81. In other words, the second position determining hole 82 is located in a position apart from the first position determining hole 81 by predetermined distances in the first direction and the second direction, in the plan view viewed from the guide plate 50 side of the base plate 20. By performing such position determining, the first opening portion 61 is located apart from the first position determining hole 81 by predetermined distances in the first direction and the second direction, in the above-described plan view.

As described above, the first opening portion 61 and the second position determining hole 82 are formed in predetermined positions on the uppermost layer portion 51 with high accuracy. Accordingly, the first opening portion 61 is located in a position apart from the first position determining hole 81 by predetermined distances in the first direction and the second direction with high accuracy. As a result, the position determining pin 22 supported by the pin support hole 60 is also located in a position apart from the first position determining hole 81 by predetermined distances in the first direction and the second direction.

In addition, as described above, the relative position of the nozzle opening 11 with respect to the position determining pin inserting hole 42 is defined with high accuracy through the position determination adjusting hole 41 of the position determining plate 40 formed by photolithography (see FIG. 3). Accordingly, when the position determining pin 22 is fitted into the position determining pin inserting hole 42, the nozzle opening 11 of the head 10 is arranged in a predetermined position on the base plate 20 with high accuracy. In other words, the nozzle opening 11 is arranged in a position apart from the position determining pin 22 by predetermined distances in the first direction and the second direction, in the plan view of the nozzle opening 11 side of the head unit 1.

As described above, the nozzle opening 11 and the position determining pin inserting hole 42 are formed in a predetermined disposition with high accuracy by the position determining plate 40. In addition, the relative position of the position determining pin 22, which is inserted into the position determining pin inserting hole 42, with respect to the first position determining hole 81 is disposed with high accuracy. Accordingly, the nozzle opening 11 is disposed in a predetermined position on the base plate 20 with high accuracy.

In addition, in this embodiment, two first position determining holes 81 and two second position determining holes 82 are formed for one guide plate 50. The reason is that, the position on the guide plate 50 is defined by determining the position of the second position determining hole 82 to be in the first position determining hole 81. In addition, the rotation angle of the guide plate 50 on the base plate 20 is defined by determining the position of the other second position determining hole 82 to be in the other first position determining hole 81.

In addition, the relative position of the first position determining hole 81 and the pin support hole 60 is the same as a combination of all the first position determining holes 81 and all the pin support holes 60. In addition, the relative positions between the first position determining holes 81 are disposed in correspondence with the relative positions of the heads 10 that are held in the base plate 20. Accordingly, the nozzle openings 11 of each head 10 are arranged with the relative gaps of the heads 10 maintained.

In this embodiment, the heads 10 are disposed as follows as the predetermined positions of the heads 10. In other words, as shown in FIG. 1, a head group 110 is configured by disposing a plurality of heads 10 in the first direction that is the aligning direction of the nozzle openings 11 of the nozzle rows 14 (see FIG. 3) of the heads 10, and four head groups 110 are arranged in parallel in the second direction. In other words, the plurality of heads 10 is disposed in the first direction and the second direction.

Described in more detail, the plurality of heads 10 is disposed in a zigzag pattern in the first direction such that the nozzle rows 14 are consecutive in the first direction. Then, two head groups 110 formed from the plurality of heads 10 that is disposed to allow the nozzle rows 14 to be consecutive in the first direction are arranged in parallel in the second direction.

Here, to dispose the nozzle rows 14 of the head groups 110 to be consecutive in the first direction is to dispose the heads 10 of each head group 110 that are adjacent in the second direction such that the nozzle opening 11 of an end portion of the nozzle row 14 of one head 10 and the nozzle opening 11 of an end portion of the nozzle row 14 of the other head 10 are to be in the same position in the first direction.

As described above, by disposing the nozzle rows 14 of the plurality of heads 10 of each head group 110 to be consecutive in the first direction, compared to a case where printing is performed by using the nozzle rows 14 of one head 10, printing for a wide range can be performed at a high speed.

As described above, the head unit 1 according to this embodiment, the nozzle openings 11 are arranged in predetermined positions on the base plate 20 with high accuracy, the ejection characteristics for ink droplets are superior. In addition, by only fitting the position determining pin 22 into the position determining pin inserting hole 42 and fixing the head 10 to the base plate 20 by using the fixation screw 35, the nozzle openings 11 of the head 10 are disposed in predetermined positions on the base plate 20 with high accuracy. In other words, the alignment of the heads 10 can be performed in an easy manner without requiring efforts or time for adjusting predetermined positions of the nozzle openings 11 of the heads 10 on the base plate 20 by using a CCD camera or the like.

In addition, the head unit 1 according to this embodiment does not need an actuator device, a parallel plate spring, or the like as a mechanism for determining the nozzle openings 11 of the head 10 to be in predetermined positions on the base plate 20. Accordingly, miniaturization and low manufacturing costs of the head unit 1 can be achieved. In addition, when a head 10 replacement operation is performed in a field in which the liquid ejecting apparatus including the head unit 1 is actually used, each head 10 can be individually replaced after being positioned with high accuracy without replacing the head unit 1.

Next, a method of manufacturing the head unit 1 according to this embodiment will be described. FIGS. 6A to 6C and 7 are schematic diagrams illustrating a method of manufacturing the head unit according to Embodiment 1 of the invention.

Figure 6A:
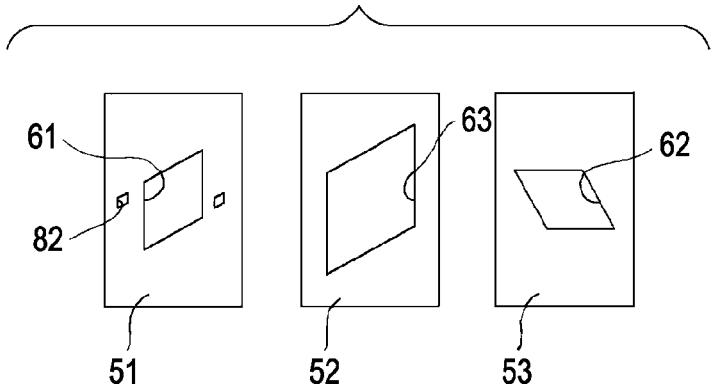
FIGS. 6A, 6B, and 6C are schematic diagrams illustrating a method of manufacturing a head unit according to Embodiment 1.

First, as shown in FIG. 6A, the first opening portion 61, the communication opening portion 63, and the second opening portion 62, which are formed by perforating the uppermost layer portion 51, the middle layer portion 52, and the lowermost layer portion 53 in the thickness direction, are formed in the uppermost layer portion 51, the middle layer portion 52, and the lowermost layer portion 53 that are formed from silicon substrates by using the photolithographic method. In addition, in the uppermost layer portion 51, the second position determining hole 82 is formed simultaneously with the first opening portion 61 so as to have the relative position with respect to the first opening portion 61 to be a predetermined disposition. Then, an adhesive agent is coated between the uppermost layer portion 51, the middle layer portion 52, and the lowermost layer portion 53, and the uppermost layer portion 51, the middle layer portion 52, and the lowermost layer portion 53 are stacked together. The communication opening portion 63 is made to communicate with the first opening portion 61 and the second opening portion 62. Thereafter, the adhesive agent is dried in the state in which the positions of the first opening portion 61 and the second opening portion 62 are determined such that the position determining pin 22, which is inserted into the pin support hole 60, is supported by the first opening portion 61 and the second opening portion 62, whereby the guide plate 50 is formed finally.

Figure 6B:
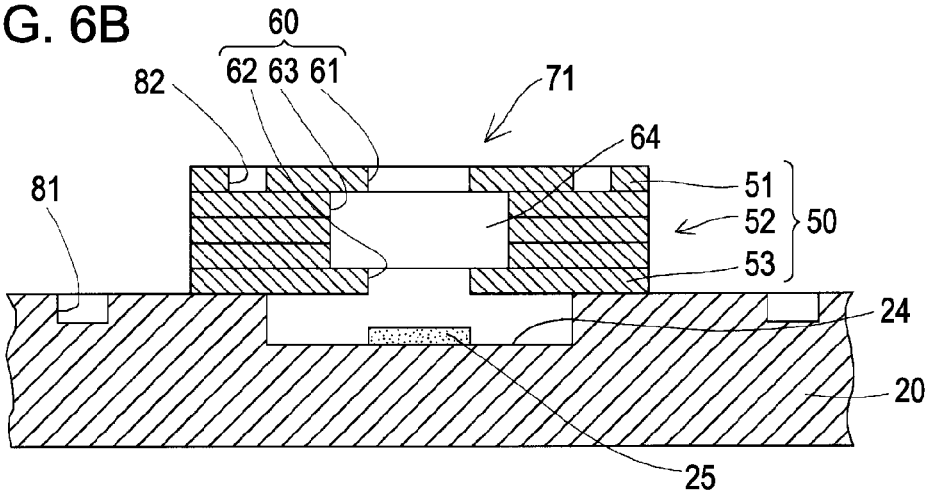

Next, as shown in FIG. 6B, the mounting groove 24 is coated with an adhesive agent 25, the position of the second position determining hole 82 of the uppermost layer portion 51, which is formed from a silicon substrate, is determined to be in the first position determining hole 81 disposed in the base plate 20, and the guide plate 50 is fixed to the base plate 20. In particular, the first position determining hole 81 and the second position determining hole 82 are photographed by using a CCD camera, and the centers of the first position determining hole 81 and the second position determining hole 82 are acquired by performing an image process for an image acquired by photographing, and the position of the guide plate 50 is adjusted such that the centers are in predetermined positions.

Accordingly, the positions of the first position determining hole 81 and the second position determining hole 82 are determined. In addition, the relative position of the second position determining hole 82 with respect to the first opening portion 61 is formed with high accuracy by photolithography, the positions of the first position determining hole 81 and the first opening portion 61 are determined in a predetermined disposition with high accuracy.

In addition, the diameter of the second position determining hole 82 is formed to be smaller than that of the first opening portion 61. Accordingly, even in a case where the resolution of the CCD camera is low, the entire second position determining hole 82 can be photographed in the field of view without zooming-out. Therefore, the center of the second position determining hole 82 can be detected with high accuracy by performing the image process.

The reason is as follows. In the image process, the shape of the opening is a rhombus, and accordingly, the center of the second position determining hole 82 is acquired by acquiring an intersection of diagonal lines of the rhombus. Thus, the entire second position determining hole 82 must be photographed in the image that is acquired by using the CCD camera. In a case where the diameter of the second position determining hole 82 is formed to have a wide diameter that is substantially equal to that of the first opening portion 61, the CCD camera must be zoomed-out so as to place the entire first opening portion 61 of the wide diameter in the field of view. Accordingly, in one pixel of an image acquired after zooming-out, a subject is photographed at a range that is wider than one pixel of an image acquired before zooming-out. Therefore, as the photograph is performed for a wider range, the error in the center of the rhombus increases.

However, in the method of manufacturing the head unit 1 according to an embodiment of the invention, the second position determining hole 82 is formed to have a diameter smaller than that of the first opening portion 61, and accordingly, zooming-out of the CCD camera can be avoided as much as possible. Accordingly, the center of the second position determining hole 82 is detected with high accuracy. Since the positions of the first position determining hole 81 and the second position determining hole 82 are adjusted based on the detected center, whereby the positions thereof can be determined with higher accuracy.

In addition, a method in which the first opening portion 61 is formed to have a small diameter, and the positions of the first opening portion 61 and the first position determining hole 81 are directly adjusted may be considered. However, in order to acquire the strength of the position determining pin 22, the position determining pin 22 is required to have a thickness to some degree, and the first opening portion 61 (the pin support hole 60) fitted with the position determining pin 22 needs to be formed to have a wide diameter corresponding thereto. As a result, in such a method, it is difficult to perform the position adjustment. However, according to an embodiment of the invention, the positions of the first opening portion 61 and the first position determining hole 81 can be indirectly adjusted through the second position determining hole 82.

Figure 6C:
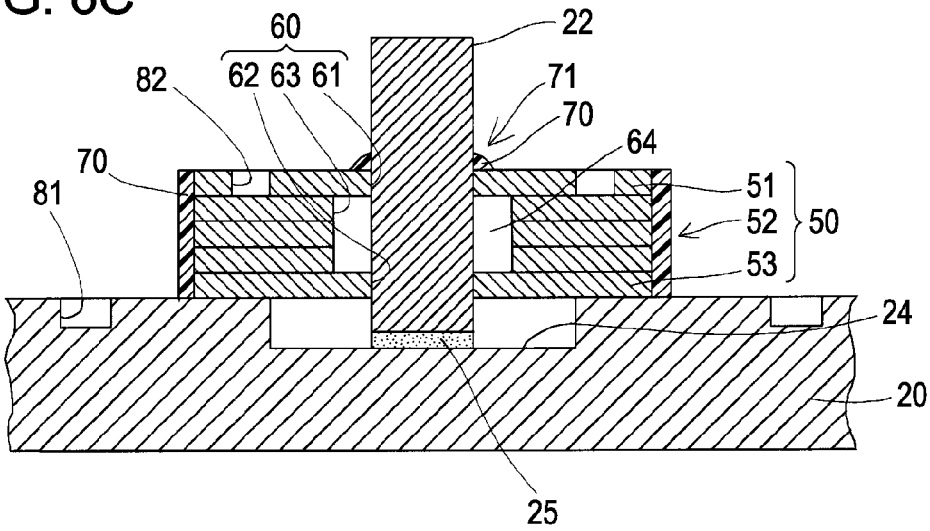

Next, as shown in FIG. 6C, the position determining pin 22 is inserted into the pin support hole 60, and the position determining pin 22 is bonded to the mounting groove 24 of the base plate 20 so as to be vertically arranged by using the adhesive agent 25. Alternatively, not the mounting groove 24 but the position determining pin 22 may be coated with the adhesive agent 25. Thereafter, although not shown in the figure, the resin 70 is arranged on the side face of the guide plate 50 or the boundary portion of the position determining pin 22 and the pin support hole 60.

Figure 7:
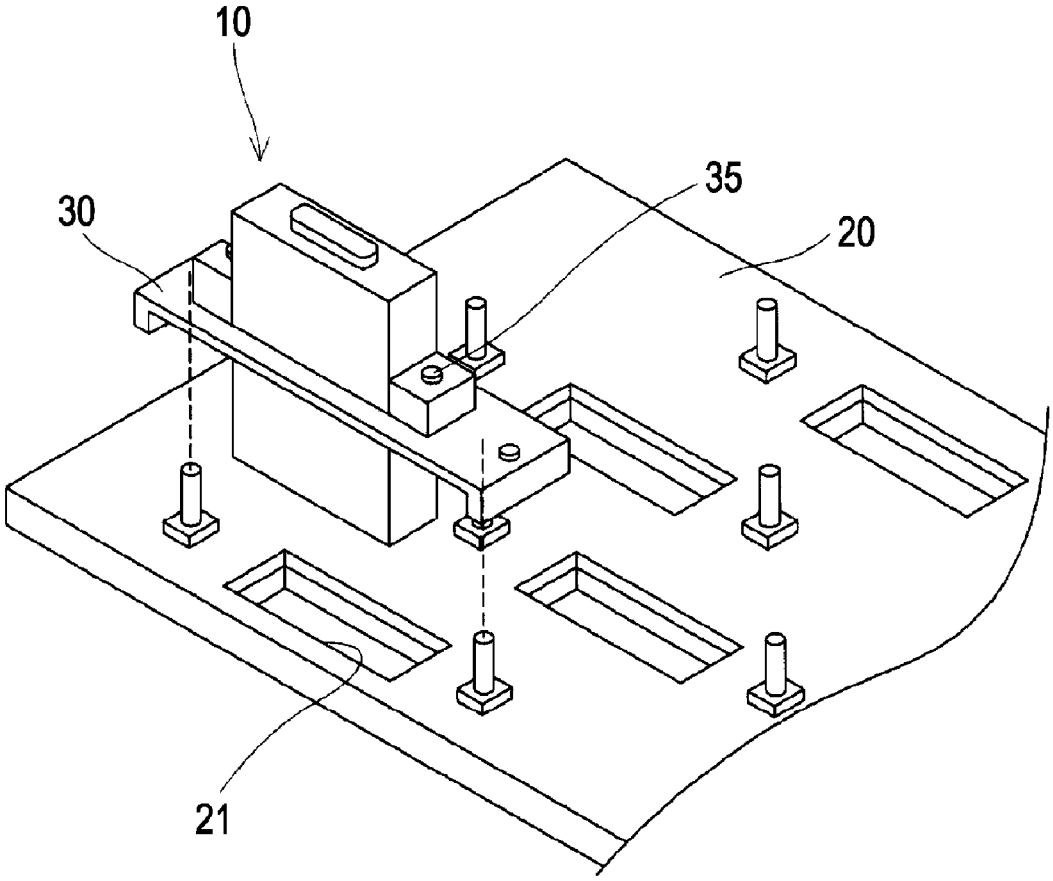
FIG. 7 is a schematic diagram illustrating a method of manufacturing a head unit according to Embodiment 1.

Next, as shown in FIG. 7, the nozzle opening 11 side of the head 10 is inserted into the through hole 21 of the base plate 20, the position determination inserting hole 42 (see FIG. 4) of the position determining plate 40 of the head 10 is fitted with the position determining pin 22, and the sub plate 30 is fixed by using the fixation screw 35, whereby the head 10 is held in the base plate 20. Accordingly, the nozzle openings 11 are arranged in predetermined positions of the base plate 20 with high density, and the nozzle openings 11 of the heads 10 are arranged with a relative gap of the heads 10 maintained therebetween.

Other Embodiments

As above, an embodiment of the invention has been described. However, the basic configuration according to an embodiment of the invention is not limited thereto.

In the above-described Embodiment 1, two nozzle rows 14 are disposed for each head 10. However, the invention is not limited thereto. Thus, for example, one nozzle row 14 may be disposed for each head 10, or three or more nozzle rows may be disposed for each head 10.

In addition, in the above-described Embodiment 1, the head group 110 is configured by three heads 10. However, the invention is not particularly limited thereto. Thus, the head group 110 may be configured by two or more heads 10.

In addition, in the above-described Embodiment 1, two head groups 110 are arranged in the head unit 1. However, the invention is not particularly limited thereto. One head group 110 may be arranged in the head unit 1, or three or more head groups may be arrange. In addition, one head 10 may be disposed in the head unit 1.

In addition, in the above-described Embodiment 1, the head 10 includes the sub plate 30. However, the invention is not limited thereto. Thus, it may be configured that the position determining plate 40 is directly attached to the head case 15, and the position of the head case 15 is determined so as to be fixed on the base plate 20.

In addition, in the above-described Embodiment 1, the head 10 includes the position determining plate 40 in which the position determining pin inserting hole 42 is formed. However, the invention is not limited thereto. For example, the position determining pin inserting hole 42 may be formed in a member that configures the head 10 such as the head case 15. In addition, in Embodiment 1, the guide plate 50 is disposed in the base plate 20, and the position determining pin 22 is supported by the guide plate 50. However, the invention is not limited thereto. Thus, it may be configured that the position determining pin 22 and the guide plate 50 are arranged in the head 10, the position determining pin 22 is supported by the guide plate 50, and the position determining pin inserting hole 42 is disposed in the base plate 20. Even in such a case, the position determining pin 22 disposed in the head 10 is supported by the guide plate 50.

In addition, the head unit 1 according to this embodiment may be applied to so-called a line-type recording apparatus in which the head unit 1 is fixed to an apparatus main body so that the second direction matches to the transport direction of a recording medium such as a recording sheet of a liquid ejecting apparatus, which is represented by an ink jet recording apparatus, or a substrate that is capable of performing recording by transporting only the recording medium in the second direction.

In addition, the liquid ejecting apparatus is not particularly limited thereto. For example, by mounting the head unit 1 on a movement unit such as a carriage that is disposed to be movable in a direction perpendicular to the transport direction of a recording medium, the recording medium having a width larger than the length of the nozzle row 14, which is consecutive in the first direction, formed by the head group 110 of the head unit 1 can be printed. In other words, by disposing the head unit 1 such that the first direction coincides with the transport direction of the recording medium and performing recoding while moving the head unit 1 in the second direction and moving the recording medium in the first direction, a relatively large recording medium can also be recorded.

It is apparent that the number of the head units 1 mounted in the liquid ejecting apparatus is not particularly limited. Thus, a plurality of the head units 1 may be configured to be mounted in the liquid ejecting apparatus.

What is claimed is:

1. A liquid ejecting head unit comprising:

a liquid ejecting head that has a nozzle row in which a plurality of nozzle openings are arranged in parallel;

a base plate that holds the liquid ejecting head;

a position determining pin, which is fitted into a position determining pin inserting hole disposed in one of the liquid ejecting head and the base plate, disposed on the other; and a guide plate that has a pin support hole inserted into the position determining pin, wherein the guide plate is configured by a lowermost layer portion that is bonded to the other in which the position determining pin is disposed, a middle layer portion disposed on the lowermost layer portion, and an uppermost layer portion that is disposed on the middle layer portion, wherein the pin support hole is configured by a first opening portion disposed in the uppermost layer portion, a second opening portion disposed in the lowermost layer portion, and a communication opening portion that is disposed in the middle layer portion and allows the first opening portion and the second opening portion to communicate with each other, and wherein the position determining pin is supported by the first opening portion and the second opening portion.

2. The liquid ejecting head unit according to claim 1, wherein an opening edge portion of the communication opening portion is disposed on the outer side relative to that of the first opening portion or the second opening portion.

3. The liquid ejecting head unit according to claim 1, wherein any two of the uppermost layer portion, the middle layer portion, and the lowermost layer portion are formed from silicon substrates having a crystal plane orientation of (110), and wherein the crystal plane orientations of the two silicon substrates intersect with each other in the plan view of the guide plate.

4. The liquid ejecting head unit according to claim 1, wherein the position determining pin is bonded to the base plate for being fixed.

5. The liquid ejecting head unit according to claim 1, wherein a first reference is formed in the base plate, wherein the first opening portion and a second reference of which a position is determined to be the first reference are formed in the uppermost layer portion by a photolithographic method, and wherein the guide plate is attached to the base plate such that the first reference and the second reference are in a predetermined arrangement.

6. The liquid ejecting head unit according to claim 1, wherein the guide plate is formed by bonding a plurality of silicon substrates to be stacked, and wherein etching is performed for a bonding face of the silicon substrate for another silicon substrate.

7. The liquid ejecting head unit according to claim 1, wherein resin is disposed on a side face of the guide plate and a boundary portion of the position determining pin and the pin support hole.

8. The liquid ejecting head unit according to claim 1, further comprising a position determining plate, in which the position determining pin inserting hole is disposed such that a relative position with respect to the nozzle opening is in a predetermined arrangement, attached to the liquid ejecting head, wherein the liquid ejecting head is fixed to the base plate in a state in which the position determining pin is fitted into the position determining pin inserting hole of the position determining plate.

9. A liquid ejecting apparatus comprising: the liquid ejecting head unit according to claim 1.

* * * * *